US007011535B2

(12) United States Patent
Dickie

(10) Patent No.: US 7,011,535 B2
(45) Date of Patent: Mar. 14, 2006

(54) SAFETY DEVICE FOR ELECTRICAL PLUGS AND A METHOD OF ATTACHING SAME

(75) Inventor: Robert G. Dickie, Newmarket (CA)

(73) Assignee: Elumina Lighting Technologies, Inc., Ontario (CA)

( * ) Notice: Subject to any disclaimer, the term of this patent is extended or adjusted under 35 U.S.C. 154(b) by 155 days.

(21) Appl. No.: 10/713,375

(22) Filed: Nov. 14, 2003

(65) Prior Publication Data

US 2005/0106909 A1 May 19, 2005

(51) Int. Cl.
*H01R 13/44* (2006.01)

(52) U.S. Cl. ..... 439/141

(58) Field of Classification Search ..... 439/141, 439/140, 149, 137

See application file for complete search history.

(56) References Cited

U.S. PATENT DOCUMENTS

| | | | | |
|---|---|---|---|---|
| 3,449,706 | A * | 6/1969 | Carissimi | 439/141 |
| 3,629,790 | A | 12/1971 | McSherry, Jr. | |
| 3,631,320 | A * | 12/1971 | Eckert | 361/1 |
| 3,683,315 | A * | 8/1972 | Kelly | 439/141 |
| 3,763,457 | A | 10/1973 | Whippo | |
| 4,810,199 | A | 3/1989 | Kar | |
| 5,030,119 | A | 7/1991 | Lowe | |
| 5,423,689 | A * | 6/1995 | Valentino | 439/141 |
| 6,062,881 | A * | 5/2000 | Ellison | 439/141 |
| 6,231,358 | B1 * | 5/2001 | Kerr et al. | 439/140 |
| 6,337,541 | B1 * | 1/2002 | Dickie et al. | 315/169.3 |
| 6,577,081 | B1 * | 6/2003 | Dickie | 315/363 |
| 6,604,954 | B1 * | 8/2003 | Chu et al. | 439/140 |

* cited by examiner

*Primary Examiner*—Gary Paumen
(74) *Attorney, Agent, or Firm*—Sand & Sebolt

(57) ABSTRACT

A safety device for preventing accidental contact with the live blades of an electrical plug during inserting or removal of the plug from a wall socket and a method for attaching the safety device to an electrical plug. The safety device includes a housing with a shield and a connector for connecting the housing to the front face of the electrical plug. The housing has a rear wall formed with apertures for receiving the blades of the plug and a channel for receiving the shield. The shield extends outwardly from the rear wall of the housing and surrounds the blades of the plug when the safety device is attached to the plug. The safety device is connected to the plug by a friction or by an adhesive. The shield collapses toward the rear wall of the housing when the plug is inserted into a wall socket and re-expands to its original position when the plug is withdrawn from the wall socket. The safety device may be attached to any complementary shaped two bladed electrical plug or to a grounded electrical plug.

24 Claims, 12 Drawing Sheets

SAFETY DEVICE FOR ELECTRICAL PLUGS AND A METHOD OF ATTACHING SAME

BACKGROUND OF THE INVENTION

1. Technical Field

This invention generally relates to electrical plugs. More particularly, the invention relates to a safety device for preventing finger contact with the blades of an electrical plug during its insertion or removal from an electrical outlet or wall socket and to a method for attaching the same to an electrical plug. Specifically, the invention relates to a safety device which can be attached to an electric plug and which provides a shield that extends outwardly toward the tips of the blades when the plug is out of the wall socket and that collapses when the plug is inserted into a wall socket.

2. Background Information

There is a growing concern for the safety of infants and young children. Particularly, the concern is for children who have not yet reached the age at which they may be reasoned with and instructed as to the dangers of household electricity. Such children may typically range in age from that of a toddler who may yet only be crawling—typically, seven to 15 months of age—up to preschool aged children who have yet to learn discipline, or have yet to reach the age at which they may be spoken to about the dangers of certain actions which they might undertake.

Almost any home where any such children live or are expected to visit, will possibly have covers placed over any unused wall sockets so as to preclude prying fingers or child-wielded objects from being inserted into the electrical wall sockets. When these covers are in place on unused wall sockets, the danger to a toddler is greatly reduced as the wall socket is not accessible and the covers are difficult to remove. When, however, a household appliance such as a lamp, is plugged into a wall socket, a completely different danger exists. In this instance, the toddler may be enticed to remove and reinsert the plug into the wall socket. This exposes them to the risk of contacting the blades of the electrical plug while they are still "live", i.e., while between 110 and 130 volts (in North America) is imposed across the blades. If the blades are contacted by the toddler's fingers, there is a high risk of electric shock to the toddler.

Devices have been proposed in the prior art for reducing such a risk. U.S. Pat. No. 6,577,081 B2, issued Jun. 10, 2003, to the present inventor, discloses such a device. U.S. Pat. No. 6,577,081 discloses a safety device on a transformer for an electrical appliance such as a baby monitor. The transformer has electrical blades projecting outwardly therefrom and a cavity is formed in the transformer housing around the area from which the blades project. An insulator is disposed within the cavity. The insulator is collapsible when the blades are inserted into a wall socket and expandable when the blades are removed from the wall socket. The insulator is in the form of a bellows-like structure that has convoluted and compressible walls.

While this transformer is specifically manufactured to ensure that the electric shock risk to toddlers is reduced, there are numerous standard electric plugs, both grounded and ungrounded, where there is no protective feature to prevent toddlers' fingers from coming into direct contact with the electrical blades of the plugs while they are live. There is therefore a need in the art to provide a safety device for use with standard electrical plugs.

SUMMARY OF THE INVENTION

The object of the present invention is to provide a safety device that may be attached to any suitably shaped standard wall plug.

The safety device includes a backplate or housing that has a channel formed proximate its perimeter, a shield disposed within the channel and expandable outwardly therefrom, and a connector for securing the housing to an electrical plug. The shield is manufactured from a dielectric material and preferably is in the form of a collapsible bellows-type structure. The shield is of a sufficient length to extend substantially to the tips of the blades when the safety device is connected to the plug and the plug is not inserted into a wall socket. The shield collapses as the plug is inserted into a wall socket and re-expands to its original position when the plug is withdrawn from the wall socket. The shield substantially prevents fingers from coming into contact with the blades during insertion or removal of the plug from the wall socket.

It is contemplated that the safety device will be sold in the form of a kit that will allow a consumer to attach an insulating shield to any electrical plug in their home, daycare facility or the like. The kit may include a preassembled safety device or one in which the various component parts need to be assembled by the consumer before installation of the safety device on an electrical plug.

BRIEF DESCRIPTION OF THE DRAWINGS

The preferred embodiments of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
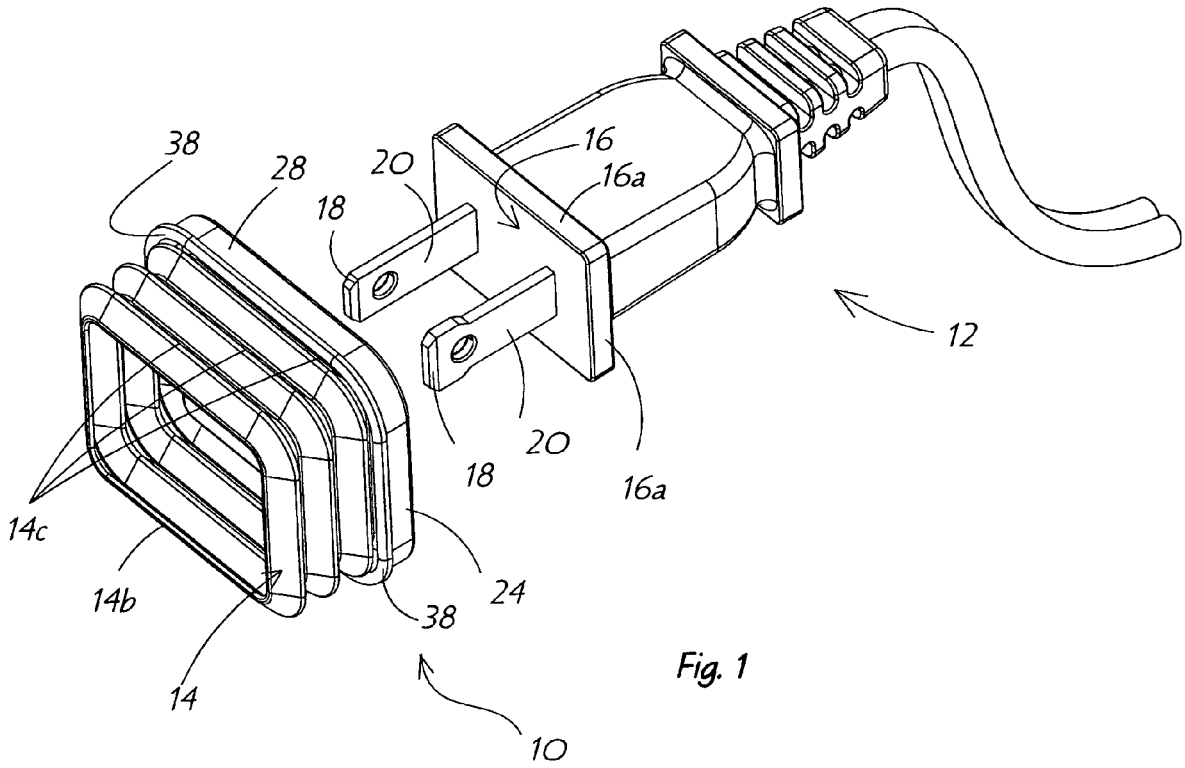
FIG. 1 is a perspective view of a safety device in accordance with the present invention, the safety device shown with a standard two-blade electrical plug.

Referring to FIGS. 1–6, there is shown a first embodiment of a safety device in accordance with the present invention and is generally indicated at 10. Safety device 10 is adapted to be attached by a consumer to any complimentary-shaped standard two-bladed plug 12. Safety device 10 includes a shield 14, a housing 24 and a connector for attaching the housing 24 to the front face 16 of a plug 12. Shield 14 extends outwardly from housing 24 toward the tips 18 of the electrical blades 20 and surrounds blades 20. Tips 18 may extend slightly beyond the second end 14*b* of shield 14 for easier insertion of blades 20 into an electrical outlet or wall socket 22. As blades 20 are inserted into wall socket 22, shield 14 is compressed or collapsed so that front face 16 of plug 12 can contact wall socket 22. As plug 12 is withdrawn from wall socket 22, shield 14 returns to its uncompressed or original state where it surrounds blades 20 and extends almost to tips 18 of blades 20. During both the insertion and removal of plug 12 from wall socket 22, shield 14 prevents the fingers of the user from coming into contact with blades 20.

Figure 5:
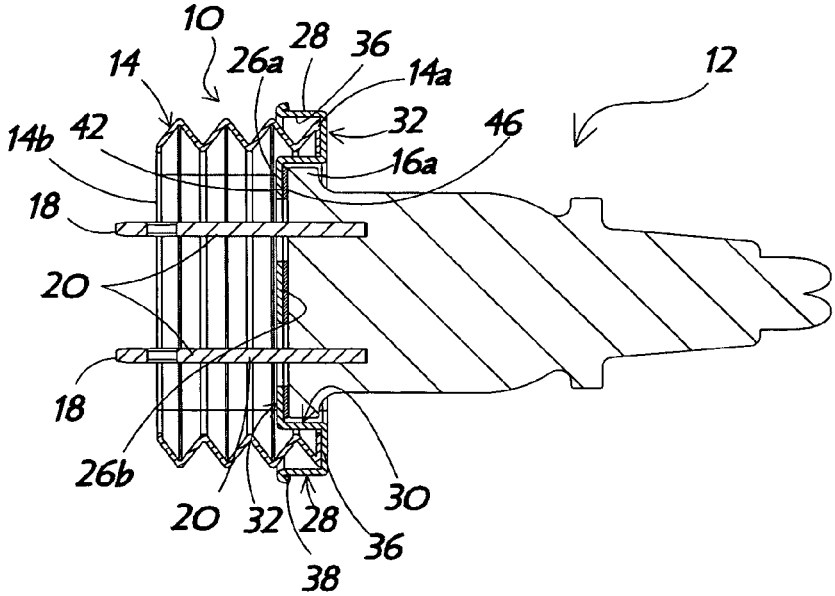
FIG. 5 is a cross-sectional top view of the shield and plug through line 5–5' of FIG. 4.
Figure 6:
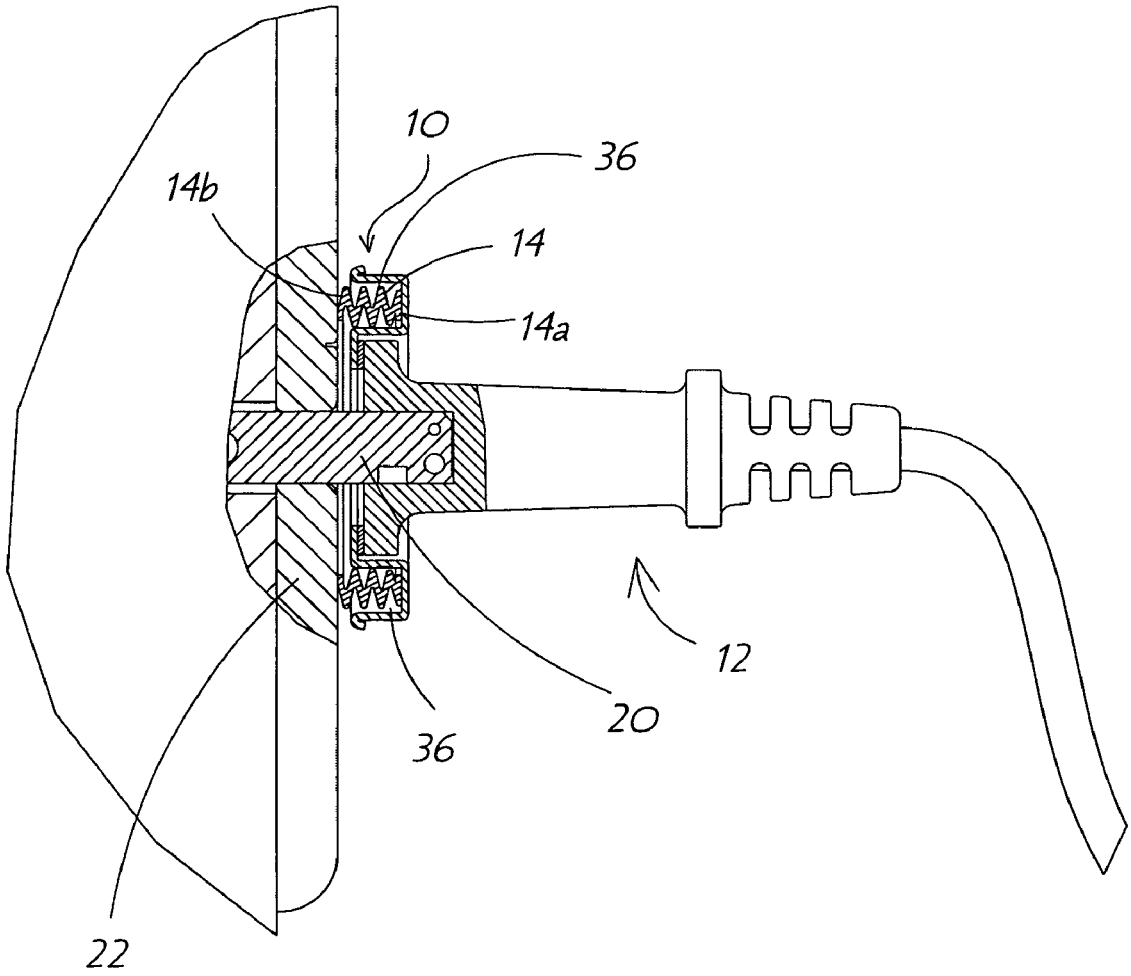
FIG. 6 is a partial cross-sectional side view showing the plug inserted into a wall socket and showing the collapse of the safety device.
Figure 7:
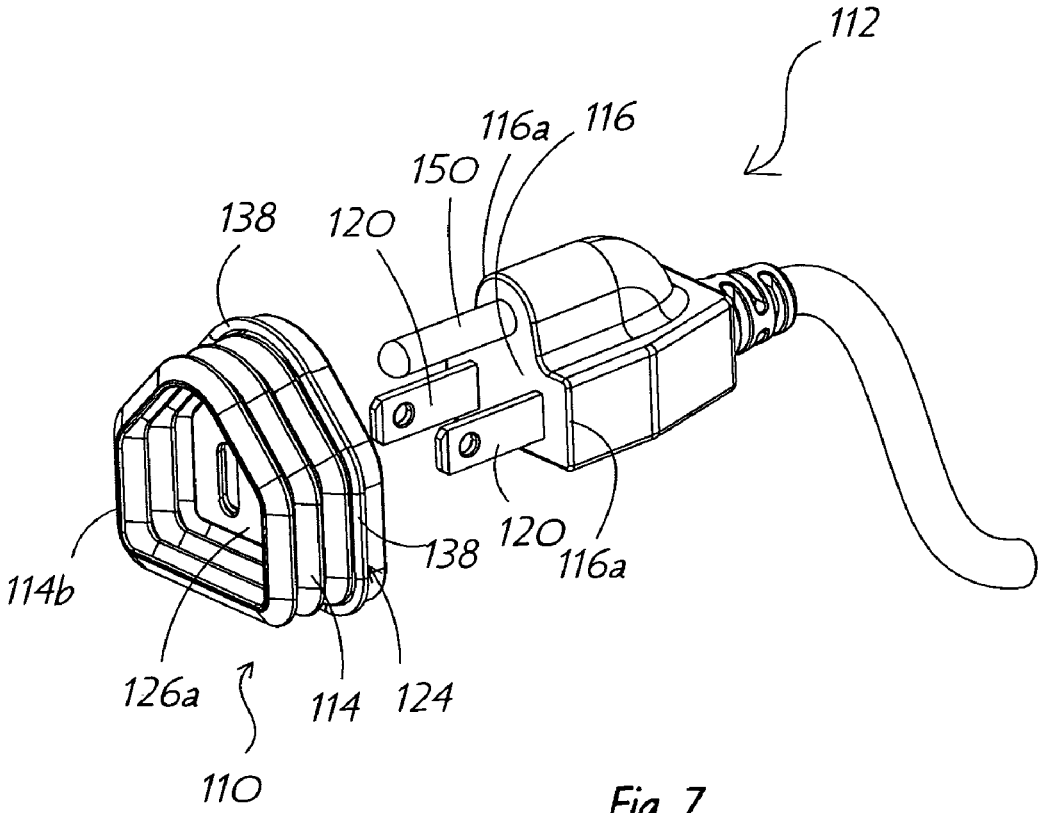
FIG. 7 is a perspective view of a second embodiment of the safety device shown with a standard grounded electrical plug.
Figure 8:
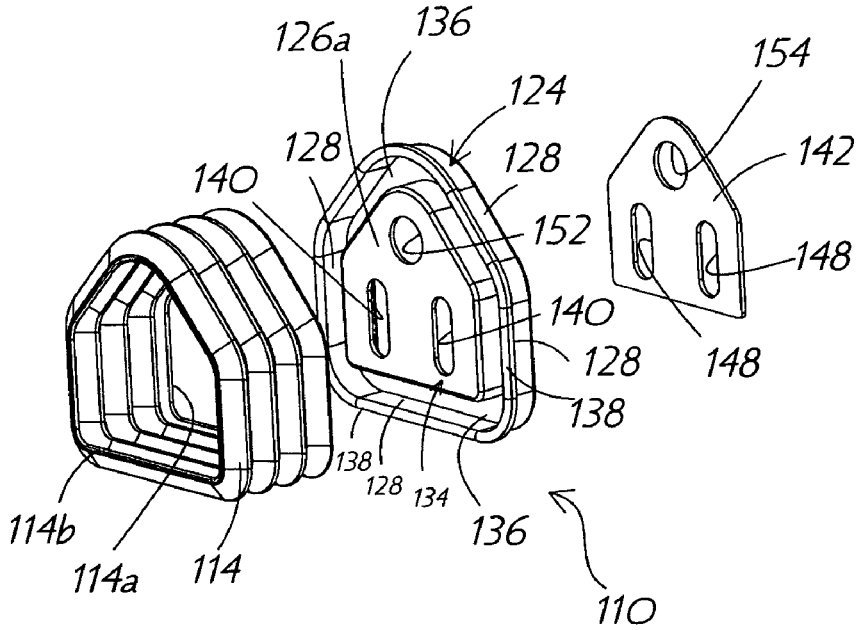
FIG. 8 is an exploded perspective view of the safety device shown in FIG. 7.
Figure 9:
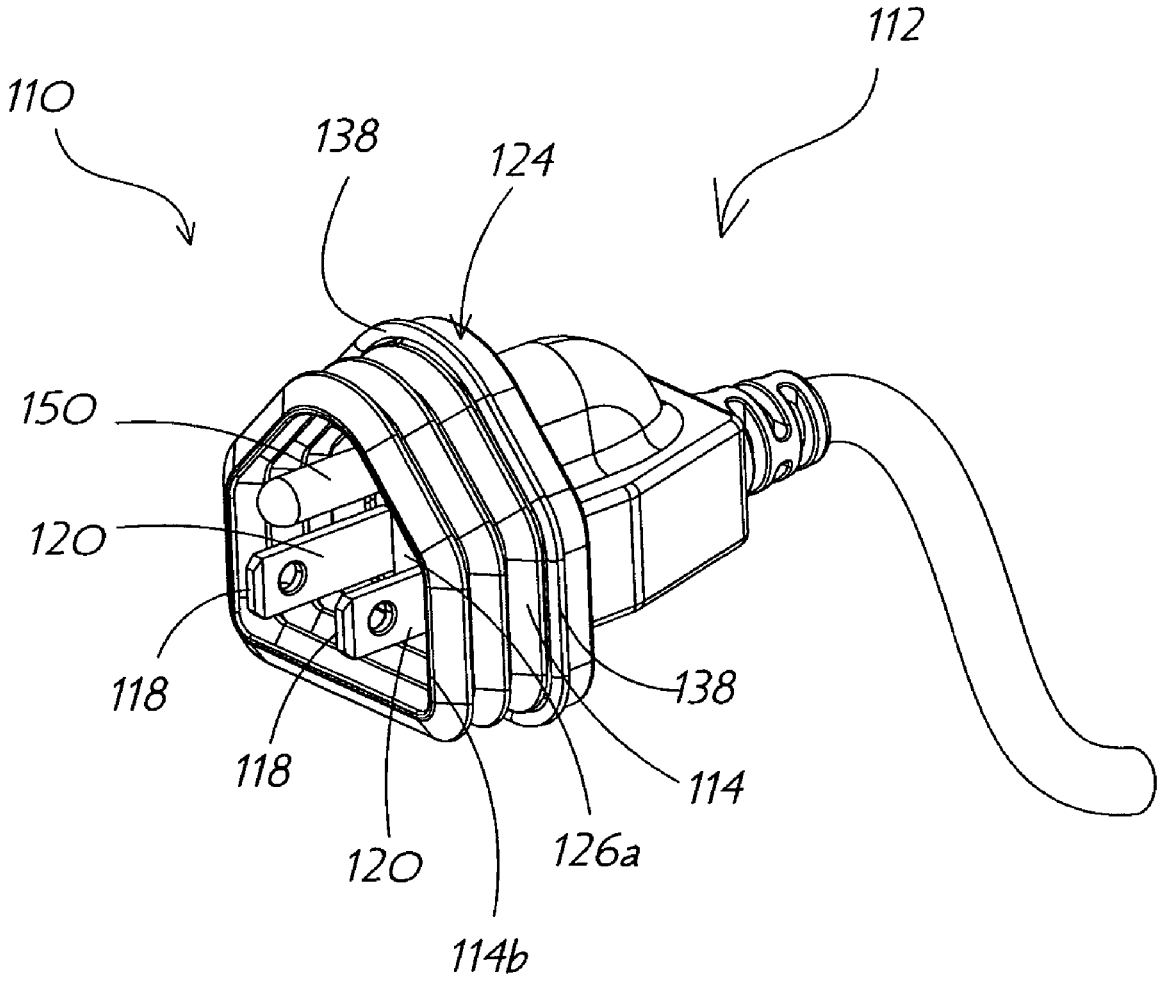
FIG. 9 is a perspective view of the second embodiment of the safety device installed on the standard grounded plug.
Figure 10:
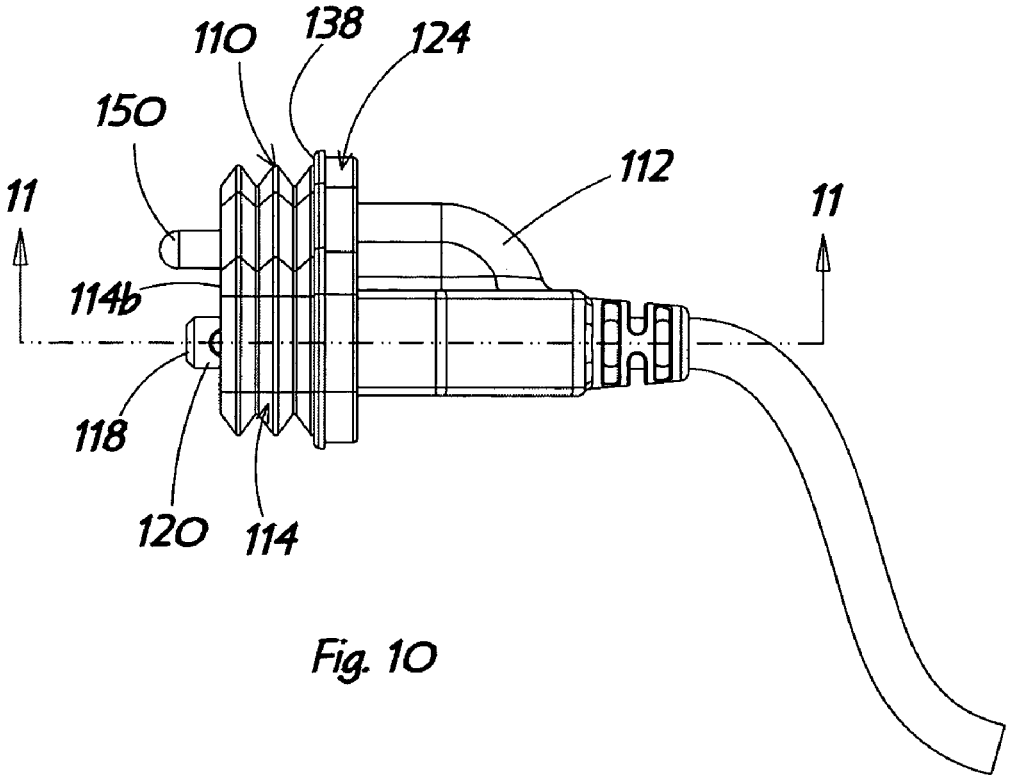
FIG. 10 is a right side view of the safety device and plug shown in FIG. 9.

Referring still to FIGS. 1–6, housing 24 has a rear wall 26 with a front surface 26*a* and a rear surface 26*b* (FIG. 5). Side walls 28 extend outwardly from rear wall 26 and extend preferably at right angles thereto. Housing 24 may be molded from plastic or manufactured from some other fairly rigid material. Rear wall 26 is formed with a cavity 30 that is complementary sized and shaped with the front face 16 of plug 12. Shoulders 32 extend around cavity 30. Cavity 30 manifests itself as a raised central area 34 on the inner surface 26*a* of rear wall 26. Shoulders 32 manifest themselves as a peripheral channel (recess) 36 that surrounds central area 34. While channel (recess) 36 is shown as a single continuous channel surrounding apertures 40, it will be understood that a plurality of smaller channels (not shown) may be provided at intervals around apertures 40 to hold first end 14*a* of shield 14. A lip 38 is formed around the edge of side walls 28 so that as shield 14 expands and collapses, it will not be damaged by side walls 28. Two spaced-apart apertures 40 are formed in rear wall 26. Apertures 40 are adapted to receive blades 20 through them when safety device 10 is attached to plug 12. It will be understood that instead of two apertures 40, one larger single aperture may be provided for receiving blades 20 therethrough. Apertures 40 are sized so that they are wider and/or taller than the blades 20 which are to be inserted through them.

Shield 14 preferably is in the form of bellows that are able to expand and collapse as is shown and described in U.S. Pat. No. 6,577,081 B1 issued to the present inventor, the entire specification of which is incorporated herein by reference. Shield 14 preferably is made of a non-conductive and resilient dielectric material such as rubber, vinyl, polyvinyl chloride, polyurethane and mixtures, polymers, copolymers and derivatives thereof. It may therefore easily expand and collapse while preventing the flow of electrical current from blades 20 to the fingers of the user. Shield 14 has a first end 14*a* and a second end 14*b* with a plurality of folds 14*c* of material between them. First end 14*a* is received within channel 36 and may be secured therein by friction, an adhesive or any other suitable means. When first end 14*a* is received within channel 36 and shield 14 is not in its collapsed state, second end 14*b* is disposed proximate tips 18 of blades 20. When shield 14 is in its collapsed state, folds 14*c* are disposed substantially within channel 36.

Figure 2:
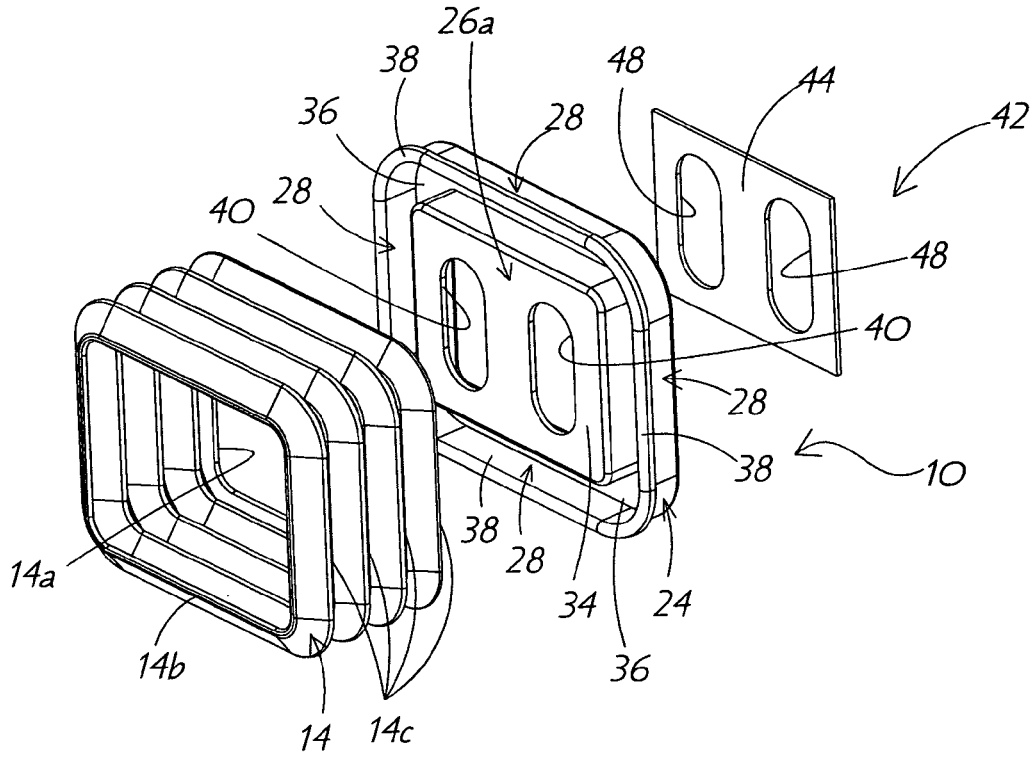
FIG. 2 is an exploded perspective view of the safety device shown in FIG. 1.
Figure 3:
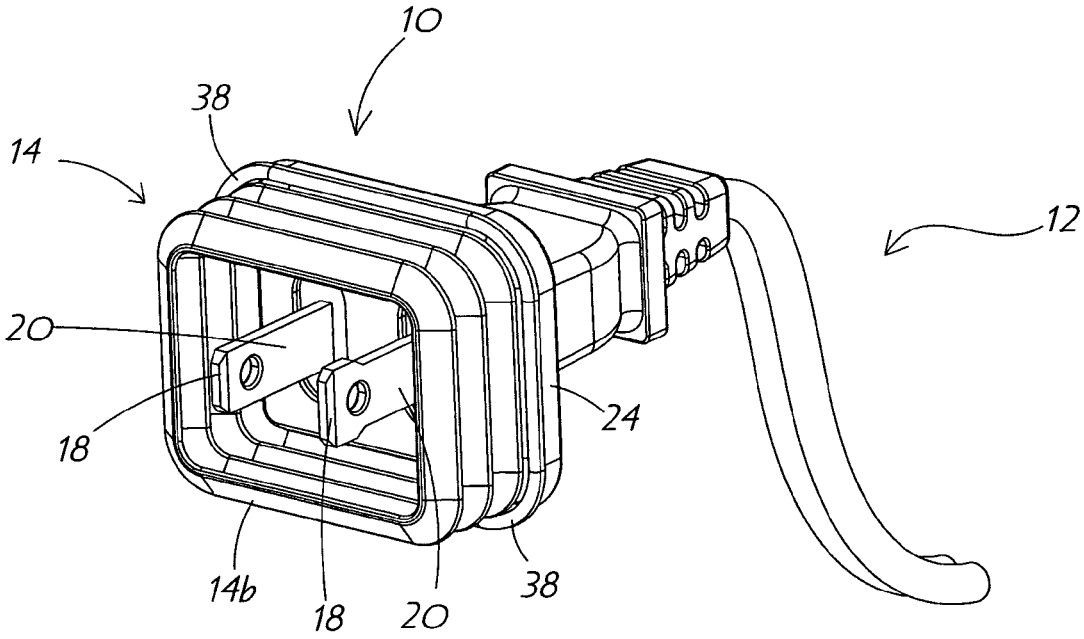
FIG. 3 is a perspective view of the safety device installed on the plug.
Figure 4:
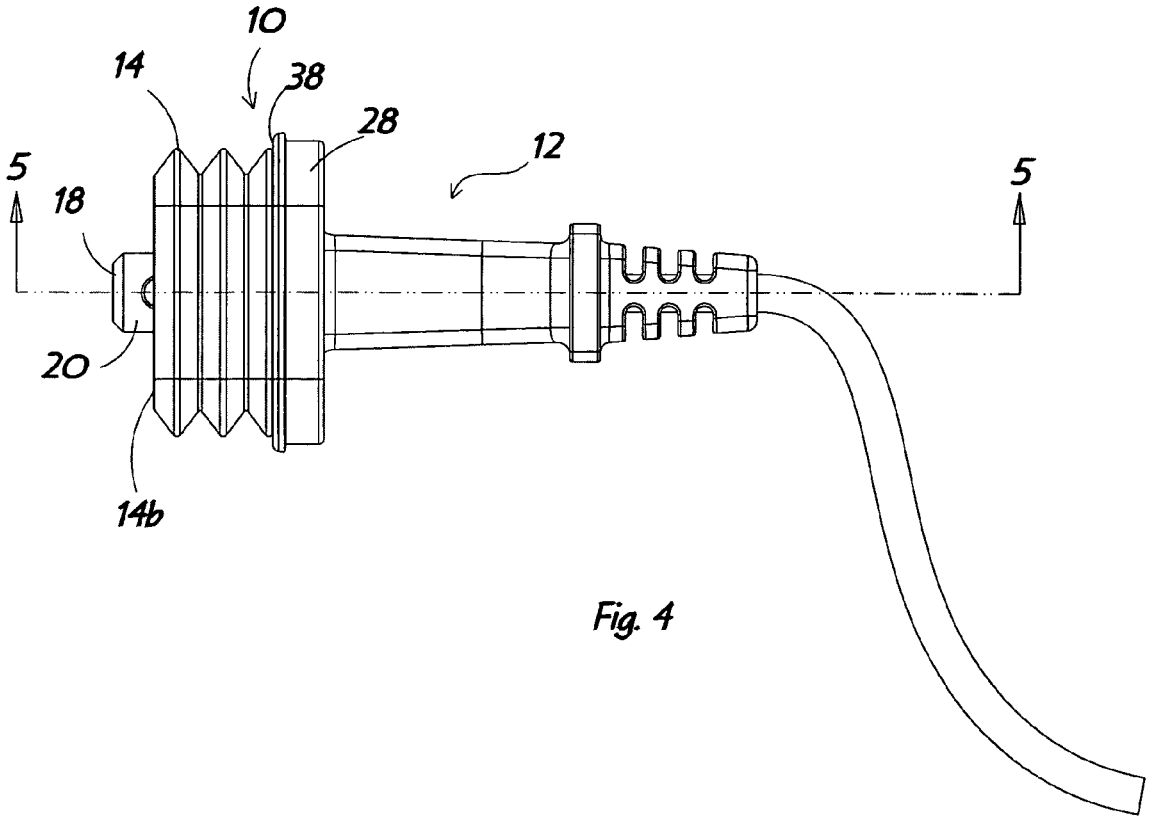
FIG. 4 is a right side view of the shield and plug of FIG. 2.

The connector for securing housing 24 to front face 16 of plug 12 may take several forms. The connector may adhesively or frictionally connect housing 24 to front face 16 of plug 12. As is shown in FIG. 2, an adhesive pad 42 may be provided for connecting safety device 10 to plug 12. Pad 42 preferably is of the same size and shape as front face 16 of plug 12. However it is understood that a number of smaller adhesive strips (not shown) may be provided to connect safety device 10 to plug 12. Alternatively, an adhesive may be applied directly to rear surface 26*b* of rear wall 26 and be covered by kraft paper for later removal by the consumer. Adhesive pad 42 preferably has an adhesive applied to both its inner surface 44 and outer surface 46 so that it may be fixed to housing 24 on one side and to front face 16 of plug 12 on the other side. Pad 42 may be secured to housing 24 by some other suitable means. Pad 42 if formed with a pair of apertures 48 of similar size and shape to apertures 40 in housing 24. Prior to application of pad 42 to housing 24 and plug 12, both inner and outer surfaces 44 and 46 may be covered with a protective sheet of kraft paper or the like to prevent the adhesive from becoming either contaminated or attached to other fixtures in the environment. Safety device 10 may be sold with adhesive pad 42 as a separate component to be applied by the user or pad 42 may be attached to outer surface 26*b* during manufacture. In this instance, only outer surface 46 of pad 42 would be covered by a protective sheet for later removal by the user.

Figure 11:
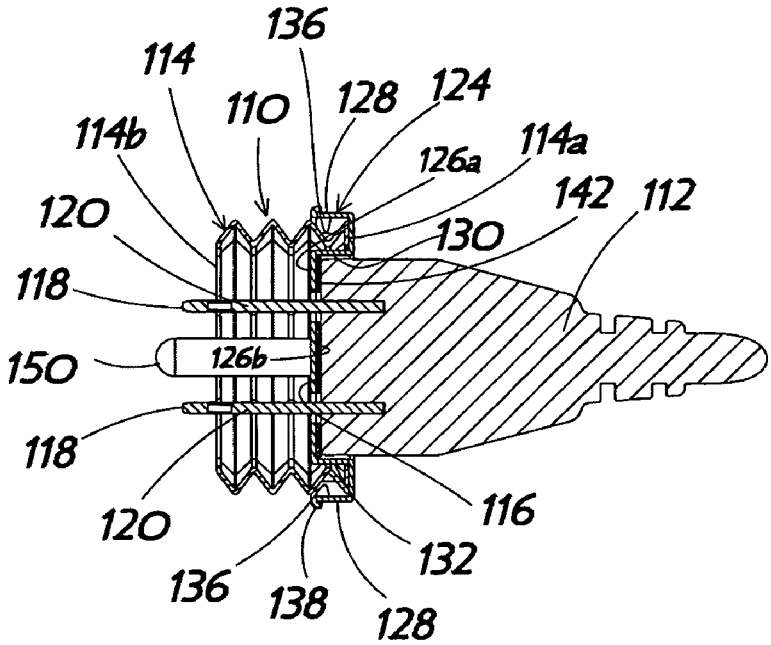
FIG. 11 is a cross-sectional top view of the safety device and plug through line 11–11' of FIG. 10.
Figure 12:
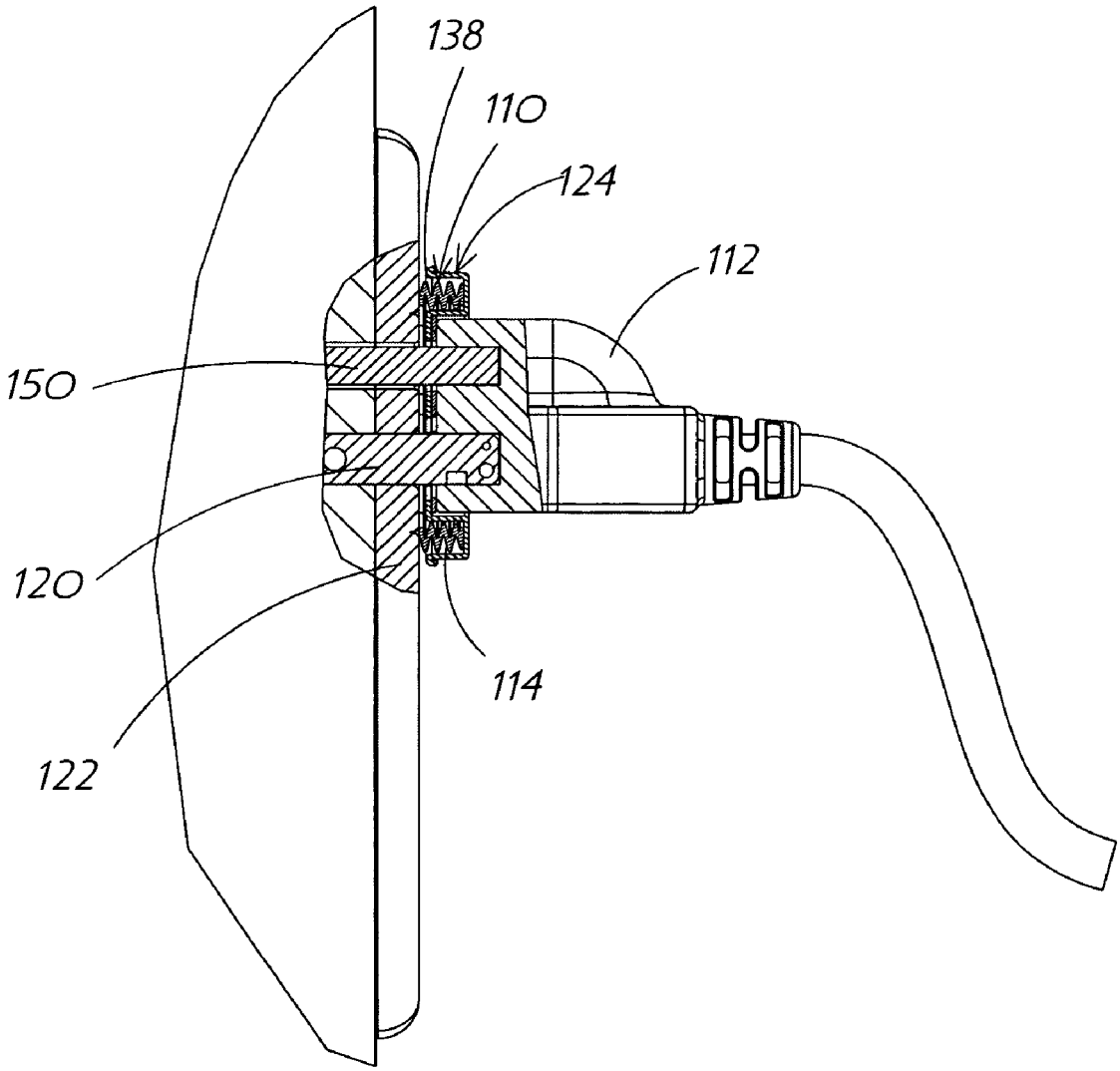
FIG. 12 is a partial cross-sectional side view of the grounded plug inserted into a wall socket, showing the collapse of the safety device.

A second embodiment of the safety device is shown in FIGS. 7–12 and is generally indicated at 110. Safety device 110 is adapted for installation on a standard grounded electrical plug 112 that has two blades 120 and a grounding pin 150. Safety device 110 comprises a housing 124 formed with a cavity 130 shaped and sized to receive a front face 116 of a plug 112. Housing 124 has a rear wall 126 which has a front surface 126*a* and a rear surface 126*b* (FIG. 11) and side walls 128 extend outwardly and generally at ninety degrees from rear wall 126. Shoulders 132 are formed around cavity 130. When safety device 110 is installed onto plug 112, front face 116 of plug 112 is received within cavity 130 as is shown in FIG. 11 and shoulders 132 abut the outer edges 116*a* of front face 116. Cavity 130 forms a raised central area 134 on inner surface 126*a* of rear wall 126. Shoulders 132 form a peripheral channel 136 that surrounds central area 134 and a shield member 114 is received within channel 136. Rear wall 126 is formed with two spaced apart apertures 140 through which blades 120 of plug 12 are inserted and a hole 152 through which pin 150 is received. Apertures 140 are sized so that they are larger than blades 120 which are to be inserted therethrough. Hole 152 may be either larger than the diameter of pin 150 or it may be of similar dimensions.

An adhesive pad 142 preferably is provided for connecting safety device 110 to plug 112. Pad 142 is generally of the same size and shape as front face 116 of plug 112, although it may be of any other suitable size and shape. Additionally, more than one adhesive pad or strip may be provided to connect housing 124 to plug 112 or an adhesive may be applied directly to outer surface 126*b* of rear wall 126.

Adhesive pad 142 functions in the same manner as previously described pad 42. Pad 142 is formed with a pair of holes 148 through which blades 126 are receivable and a third hole 154 through which pin 150 is received. As with the first embodiment of the safety device, when plug 112 is inserted into wall socket 122, shield 114 is compressed. When plug 112 is removed from wall socket 122, shield 114 re-expands to its original position where its second end 114*b* extends almost to the ends 118 of plug 112.

Figure 13:
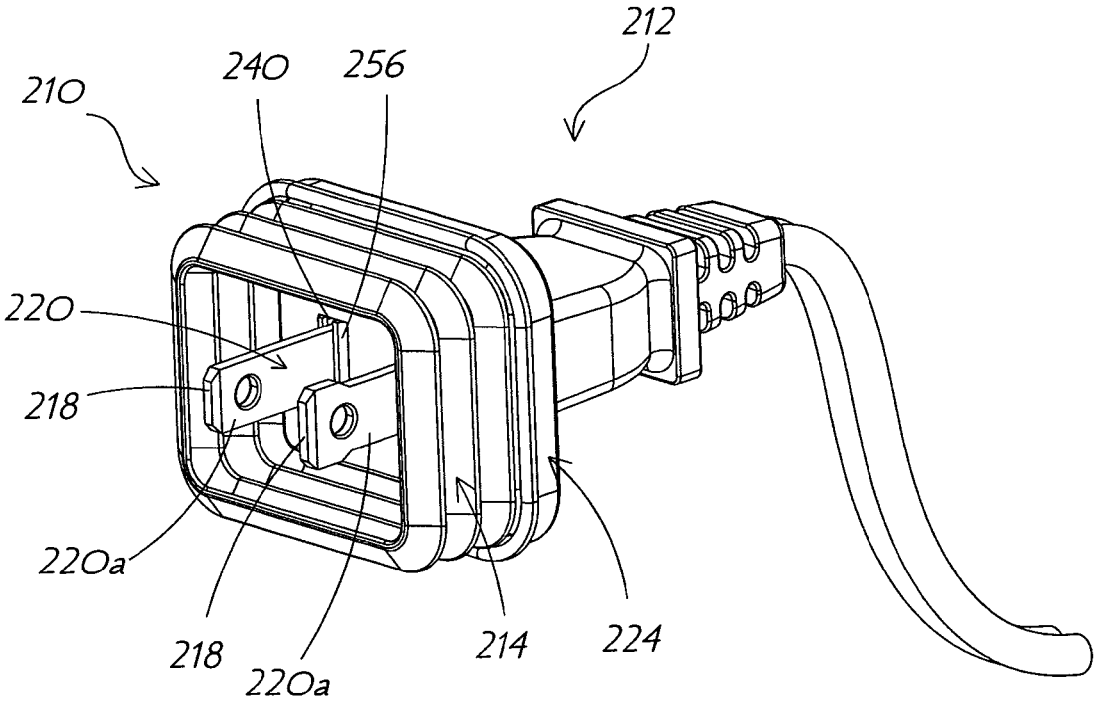
FIG. 13 is a perspective view of a third embodiment of the safety device installed on a standard two-blade plug.
Figure 14:
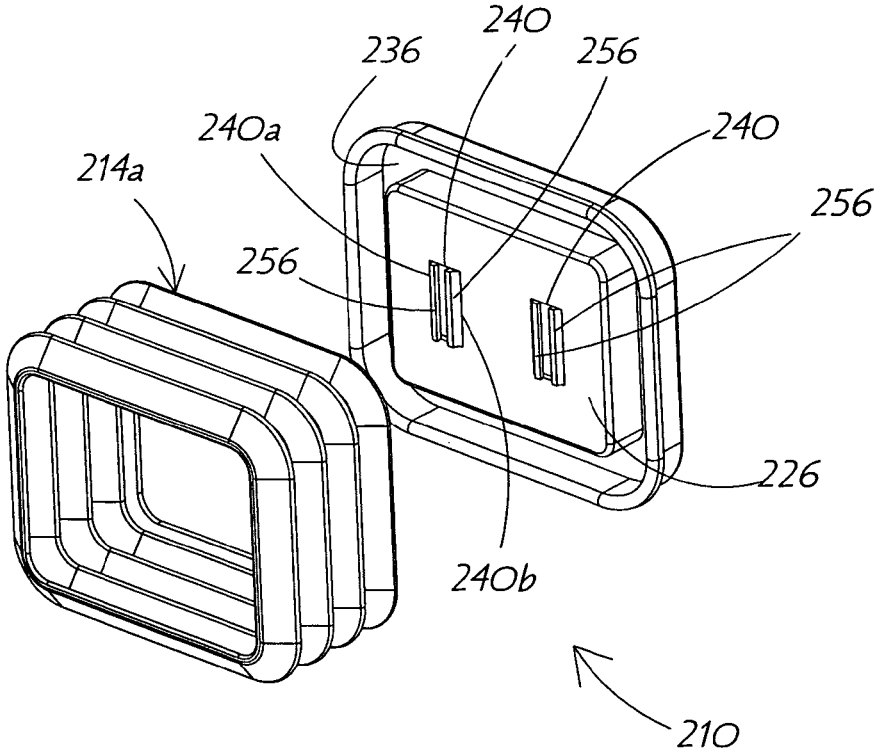
FIG. 14 is an exploded perspective view of the safety device shown in FIG. 13.
Figure 15:
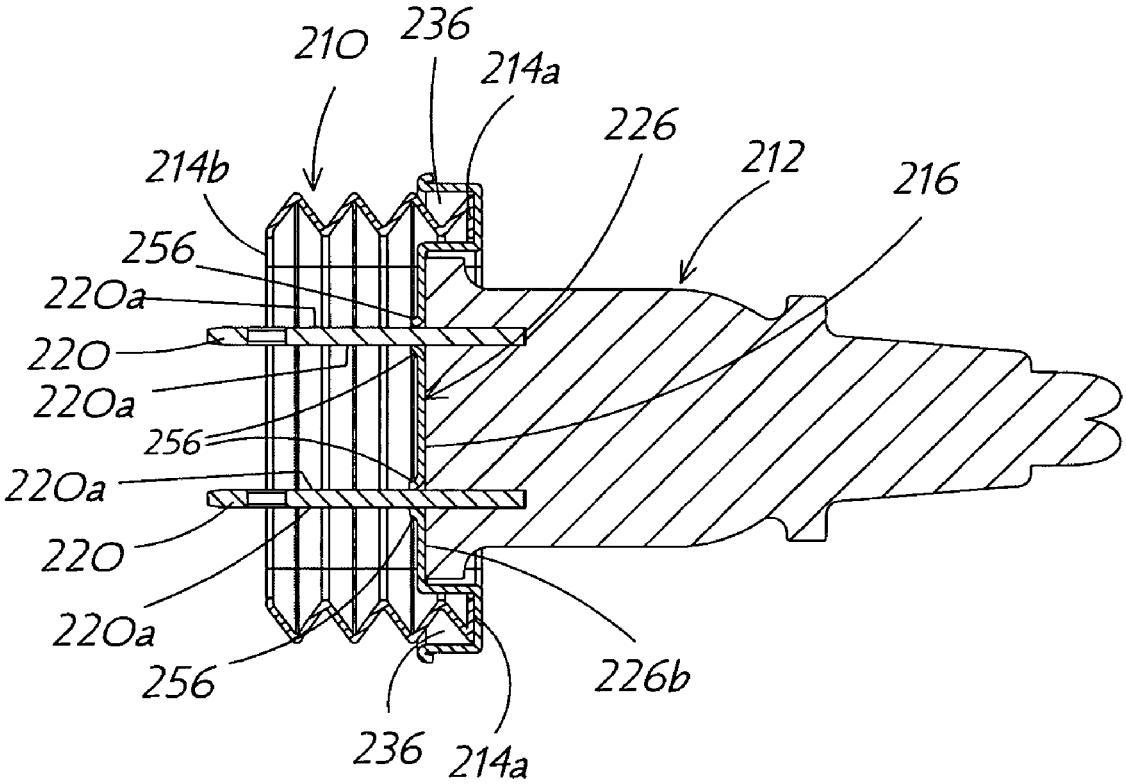
FIG. 15 is a cross-sectional top view of the safety device installed on the two-bladed plug.

A third embodiment of the safety device is shown in FIGS. 13–15 and is generally indicated at 210. Safety device 210 has basically the same structure as safety device 10, except that it is connected to plug 212 by friction. In this embodiment, the rear wall 226 defines two substantially rectangular slits 240 that have a flange 256 disposed on both of the opposing sides 240*a*, 240*b* of each slit 240 and that extend at least partially into the slit. As the ends or tips 218 of blades 220 are inserted into slits 240, they push flanges 256 slightly apart. When front face 216 of plug 212 comes to rest against the outer surface 226*b* of rear wall 226, flanges 256 frictionally hold blades 220 in place with a force sufficient to prevent the accidental removal of blades 220 from slit 240 when plug 212 is withdrawn from a wall socket (not shown).

Figure 16:
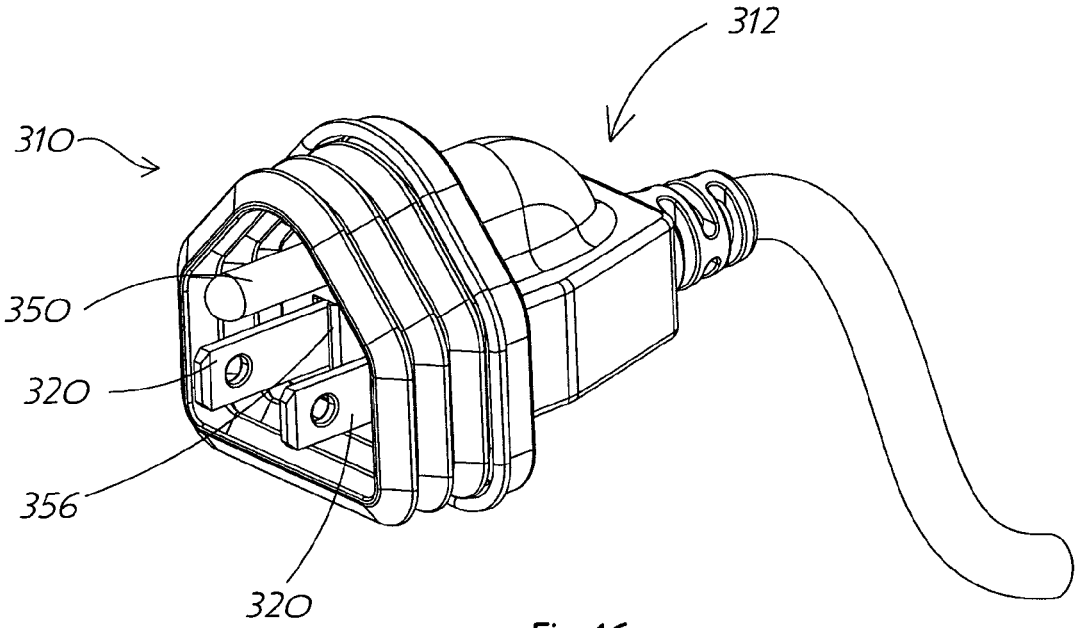
FIG. 16 is a perspective view of a fourth embodiment of the safety device installed on a standard grounded plug.
Figure 17:
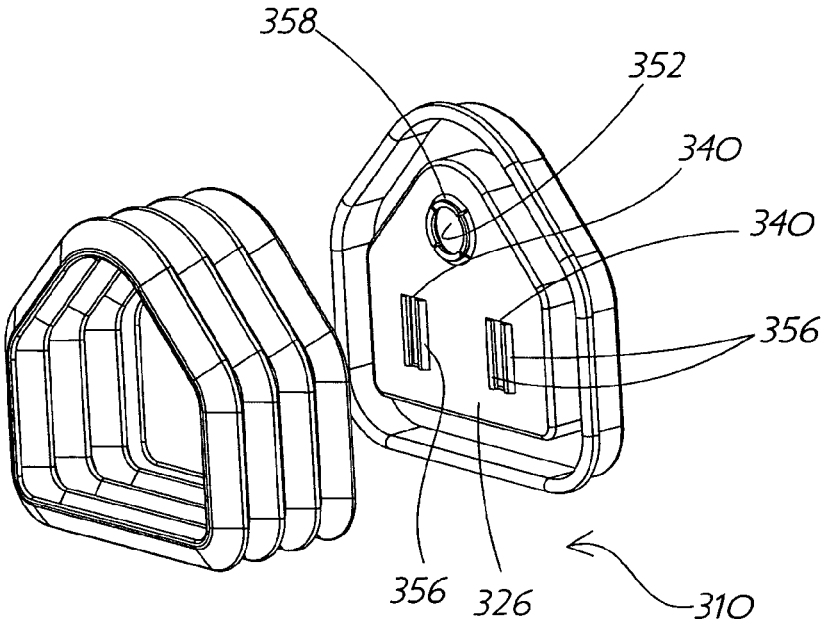
FIG. 17 is an exploded perspective view of the safety device of FIG. 16.
Figure 18:
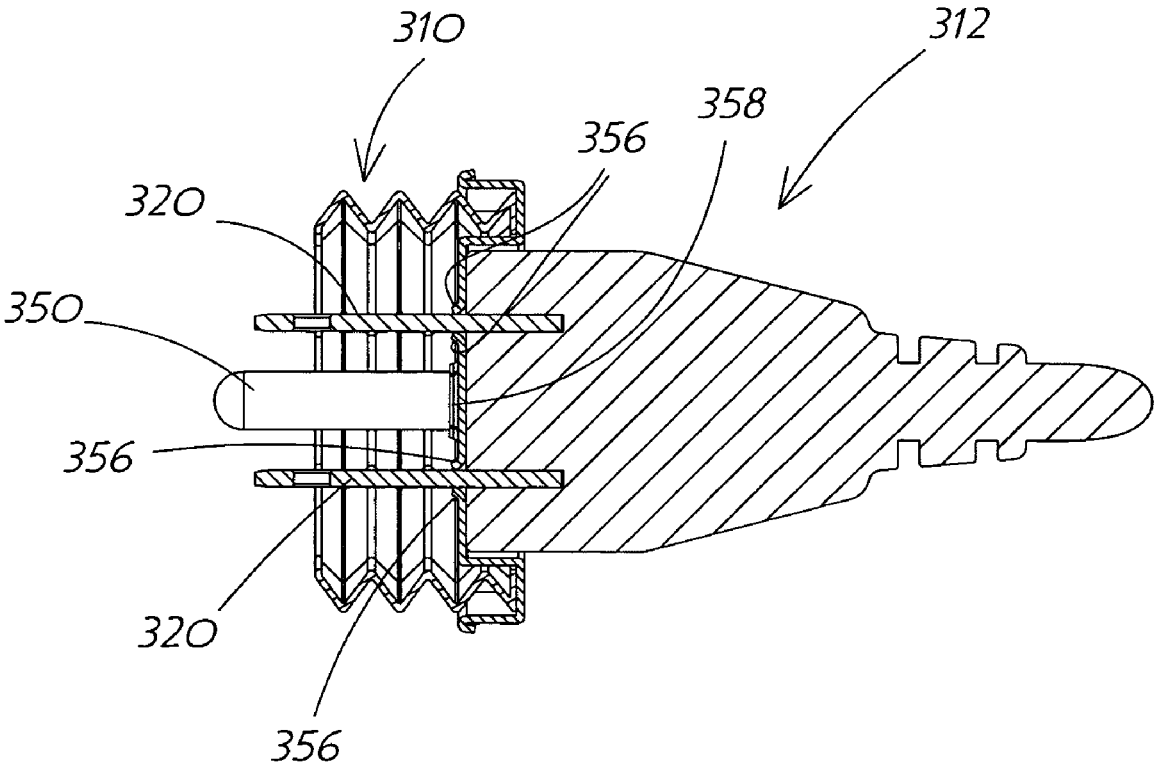
FIG. 18 is cross-sectional top view of the safety device installed on the grounded plug.

A fourth embodiment of a safety device is shown in FIGS. 16–18 and generally indicated at 310. This embodiment is adapted to be connected to a standard grounded electrical plug 312. Safety device 310 is of the same basic size, shape and function as the second embodiment of safety device 110, except that it is connected to plug 312 by friction and not by an adhesive pad. Safety device 310 includes a pair of slits 340 that are generally rectangular in shape and are slightly wider than the thickness of blades 320 of plug 312. Flanges 356 are provided on both of the opposing longer side walls of slits 340. Additionally a third hole 352 is provided in the rear wall 326 for receiving a grounding pin 350 therethrough. Hole 352 preferably is sized to be slightly larger in diameter than a standard grounding pin 350 which may be received therethrough. Hole 352 is provided with at least one pair of opposing flanges 358 that extend at least partially into third hole 352. Flanges 358 assist in preventing the withdrawal of grounding pin 350 from hole 352 when plug 312 is removed from a wall socket (not shown). Flanges 358 may encircle hole 352 in sets of opposing pairs to assist in frictionally connecting safety device 310 to plug 312.

The first and second embodiments of the safety device, namely 10 and 110, are used in generally the same way. The following description will reference safety device 10 only. Safety device 10 preferably will be manufactured with shield 14 pre-installed into housing 24. Adhesive pad 42 may be provided as a separate entity. If this is the case, the user would remove the protective covering (not shown) from one of the inner and outer surfaces 44, 46. That surface 44 or 46 with the adhesive now exposed, is pressed into contact with either front face 16 of plug 12 or outer surface 26*b* of housing 24. Presuming that inner surface 44 is pressed into contact with outer surface 26*b* of housing 24, the protective covering is then removed from outer surface 46 of adhesive pad 42. Blades 20 of plug 12 are inserted through apertures 48 and 40 in adhesive pad 42 and housing 24 respectively. Plug 12 is moved toward housing 24 until outer surface 46 contacts front face 16 of plug 12 and adhesive pad 42 becomes sandwiched between front face 16 and rear wall 26 of housing 24. Plug 12 and shield 10 are then connected together and are not easily separated. At this point, shield 14 is in an expanded or uncompressed state extending outwardly from housing 24 toward the tips 18 of blades 20. The second end 14*b* of the shield 14 is disposed slightly inwardly of tips 18 of blades 20, and direct contact with blades 20 by small fingers or objects is substantially prevented. Blades 20 of plug 12 may then be inserted into the mating components of wall socket 22. As tips 18 of blades 20 are pushed into wall socket 22, shield 14 begins to be compressed or collapsed toward housing 24 and into channel 36. When plug 12 is fully inserted into wall socket 22 (FIG. 6), shield 14 is almost entirely contained within channel 36. As plug 12 is withdrawn from wall socket 22, shield 14 returns to its uncompressed or expanded state (FIG. 5). During both insertion and removal of plug 12 from wall socket 22, direct contact with blades 20 is substantially prevented.

It will be understood that the first and second embodiments of the safety device may be sold as a completed unit, where the shield is pre-installed in the housing and an adhesive has been applied to the rear wall of the housing and covered with kraft paper. The consumer would purchase the completed unit, remove the kraft paper and adhesively bond the housing to the front face of the plug. Alternatively, the shield may be pre-installed in the housing and the adhesive may be provided separately as an adhesive pad or tube of adhesive. The consumer must then apply the adhesive or adhesive pad to the rear wall of the housing and then adhesively bond the rear wall to the front face of the plug. Alternatively, the safety device may be sold as a kit where the consumer must first insert the shield into the channel of the housing, then apply an adhesive or adhesive pad to the rear wall of the housing and then adhesively bond the housing to the front face of the plug. It will also be understood that the housing, shield and adhesive could be marketed as totally separate components that the consumer could combine to form the safety device as disclosed herein.

The third and fourth embodiments of the safety device, namely safety devices 210 and 310, are used in essentially the same manner as each other. As with embodiments one and two, safety devices 210 and 310 may be sold as preassembled units where the shield is pre-installed in the housing. Alternatively, the shield and housing may be separate components that the consumer has to assemble prior to attaching the safety device to an electrical plug. The following description will be made with reference to shield 210, but applies equally to shield 310. If shield 214 and housing 224 are not preassemble, the consumer must insert a first end 214*a* of shield 214 into channel 236 of housing 224. First end 214*a* is secured within channel 236 by means of friction, an adhesive or any other suitable connector. Safety device 210 is attached to plug 212 by inserting blades 220 through the narrow slits 240 in housing 224. As blades 220 are inserted into slits 240, they force flanges 256 to separate and consequently frictionally grip the sides 220*a* of blades 220. Blades 220 are inserted until front face 216 of plug 212 abuts rear wall 226 of housing 224. Flanges 256 frictionally lock blades 220 in slits 240 and substantially prevent safety device 10 from becoming disengaged from plug 212. As blades 220 are inserted into a wall socket (not shown), shield 214 retracts, collapses or is compressed into channel 236 of housing 224. As blades 220 are withdrawn from the wall socket, shield 214 expands to its original uncompressed state (FIG. 15). During insertion and removal of plug 212 from the wall socket, shield 214 substantially prevents accidental contact with the sides 220*a* of blades 220.

The safety devices 10, 110, 210, 310 are configured to fit any standard electrical plug and may consequently be utilized with any plug that has the appropriate shape. In this way, a user may attach safety devices to the electrical plugs of all of their household appliances to make them safer with respect to preventing accidental shock of a toddler who may attempt to either insert or withdraw the electrical plug from a wall socket.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A safety device for attachment to an electrical plug to prevent accidental contact with the blades that extend from the front face of the plug during insertion and removal of the plug from a wall socket, the safety device comprising:

a housing having a rear wall and side walls extending outwardly from the rear wall;

at least one blade-receiving aperture and at least one recess formed in the rear wall;

a collapsible, dielectric shield member having a first end and a second end, the first end being receivable within the recess, wherein the shield member extends outwardly from the rear wall to surround the blades when the safety device is attached to the plug; and wherein the shield member collapses toward the rear wall when the plug is inserted into the wall socket and expands to surround the blades when the plug is removed from the wall socket; and a connector to secure the housing to the electrical plug.

2. The safety device as defined in claim 1, wherein the side walls extend normally from the rear wall and the recess is formed in the rear wall proximate the side walls.

3. The safety device as defined in claim 2, wherein the rear wall has an inner surface and an outer surface, and the rear wall is formed with a cavity in the outer surface and a corresponding raised area in its inner surface.

4. The safety device as defined in claim 3, wherein the recess is formed around the perimeter of the raised area of the inner surface of the rear wall.

5. The safety device as defined in claim 3, wherein the cavity is sized to fit a complementary-shaped front face of a two-bladed electrical plug.

6. The safety device as defined in claim 1, wherein the connector comprises at least one adhesive pad, the pad having an inner surface and an outer surface, the inner surface abutting the rear wall of the housing and the outer surface being adapted to abut the front face of the electrical plug.

7. The safety device as defined in claim 6, wherein the adhesive pad is formed with at least one hole therein alignable with the aperture in the rear wall of the housing.

8. The safety device as defined in claim 7, wherein the hole in the adhesive pad is substantially identical in size and shape to the aperture in the rear wall of the housing.

9. The safety device as defined in claim 3, wherein the cavity is sized to fit a complementary-shaped front face of a grounded electrical plug.

10. The safety device as defined in claim 9, wherein a pin-receiving aperture is formed in the rear wall of the housing and is spaced apart from the blade-receiving aperture, whereby the blade-receiving aperture and the pin-receiving aperture are adapted to receive the blades and grounding pin respectively of a grounded electrical plug therein.

11. The safety device as defined in claim 10, wherein the connector is an adhesive pad and the adhesive pad is formed with a pair of holes and a third hole that are alignable with the blade-receiving aperture and the pin-receiving aperture of the rear wall.

12. The safety device as defined in claim 11, wherein the adhesive pad has an inner and an outer surface, and both the inner and outer surfaces have an adhesive applied thereto.

13. The safety device as defined in claim 1, wherein the aperture is a slit having an upper end, a lower end and opposing sides, and in which the connector comprises a flange disposed on each side of the slit and extending at least partially into the slit, whereby the opposing flanges frictionally grip a plug blade inserted into the slit when the safety device is attached to the plug.

14. The safety device as defined in claim 13, wherein the flanges extend sufficiently into the slit to grip the blade with a force sufficient to prevent withdrawal of the blade from the slit when the plug is removed from a wall socket.

15. The safety device as defined in claim 14, wherein a pin-receiving aperture is formed in the rear wall and is adapted to receive the grounding pin of a grounded electrical socket therein.

16. The safety device as defined in claim 15, wherein the connector comprises a pair of opposing flanges that extend into the pin-receiving aperture and are adapted to frictionally grip a grounding pin of a grounded electrical plug.

17. The safety device as defined in claim 1, wherein the shield member is of a sufficient length so that when expanded is disposed inwardly of the tips of the blades when the safety device is connected to the plug.

18. A method of attaching a safety device to an electrical plug having at least two electrical contact blades extending outwardly therefrom, the method comprising the steps of:

a) providing a safety device having a housing with at least one blade-receiving aperture formed therein and a recess; and a collapsible, dielectric shield member extending outwardly from the housing and adapted to surround the blades when the safety device is attached to the plug and collapsible toward the housing when the plug is inserted into the wall socket and expandable to surround the blades when the plug is removed from the wall socket;

b) inserting the blades of the plug through the aperture in the housing;

c) attaching the housing and shield member on the plug and d) securing the shield member in the recess formed on a front face of the housing.

19. The method as defined in claim 18, wherein the step of attaching the housing on the plug includes:

a) bonding a rear wall of the housing to a front face of the plug with an adhesive.

20. The method as defined in claim 18, wherein the step of attaching the housing on the plug includes:

a) providing opposing sides of the aperture with a flange; and b) inserting the blades between the flanges which frictionally attaches the housing on the plug.

21. The method as defined in claim 18, further comprising the steps of:

a) bonding a front surface of a pad to a rear surface of the housing; and b) bonding a back surface of the pad to a front surface of the plug.

22. A safety device comprising:

a housing;

means adapted for attaching the housing to an electrical plug;

an insulative structure attached to the housing and adapted for surrounding the electrical blades of the plug, said insulative structure adapted to retract as the blades are inserted into an electrical outlet and to extend to surround the blades as the blades are removed from the electrical outlet;

a recess formed in a front surface of the housing, wherein the insulative structure retracts into the recess when the electrical blades are inserted into the electrical outlet.

23. The safety device as defined in claim 22, wherein the insulative structure comprises a bellows-like member having convoluted and compressible walls.

24. The safety device as defined in claim 23, wherein the material of the insulative structure is selected from the group consisting of rubber, vinyl, polyvinyl chloride, polyurethane and mixtures, polymers, copolymers and derivatives thereof.

* * * * *